US008186610B2

(12) United States Patent
Gould et al.

(10) Patent No.: US 8,186,610 B2
(45) Date of Patent: May 29, 2012

(54) ROOF SHINGLE STRIPPER, GRINDER, BLOWER, AND HOPPER

(76) Inventors: Jerry Francis Gould, Greene, PA (US); Vivian Jane Gould, Greene, PA (US)

( * ) Notice: Subject to any disclaimer, the term of this patent is extended or adjusted under 35 U.S.C. 154(b) by 100 days.

(21) Appl. No.: 12/757,982

(22) Filed: Apr. 10, 2010

(65) Prior Publication Data

US 2010/0213295 A1 Aug. 26, 2010

Related U.S. Application Data

(63) Continuation-in-part of application No. 12/683,408, filed on Jan. 6, 2010, now Pat. No. 8,083,166.

(60) Provisional application No. 61/155,212, filed on Feb. 25, 2009.

(51) Int. Cl.
*B02C 21/02* (2006.01)
*B02C 19/00* (2006.01)

(52) U.S. Cl. ..... 241/25; 241/101.77; 241/224; 241/186.3

(58) Field of Classification Search ..... 241/101.77, 241/186.3, 222, 224, 236
See application file for complete search history.

(56) References Cited

U.S. PATENT DOCUMENTS

| | | | | |
|---|---|---|---|---|
| 4,767,067 | A * | 8/1988 | Bruer et al. | 241/81 |
| 4,938,425 | A * | 7/1990 | Williams et al. | 241/101.77 |
| 5,154,363 | A * | 10/1992 | Eddy | 241/30 |
| 5,529,250 | A * | 6/1996 | Pallmann | 241/57 |
| 6,820,830 | B1 * | 11/2004 | Lassen et al. | 241/186.3 |
| 2003/0146317 | A1 * | 8/2003 | Faccia | 241/101.742 |
| 2004/0050987 | A1 * | 3/2004 | Rossi, Jr. | 241/101.77 |
| 2010/0032508 | A1 * | 2/2010 | Post et al. | 241/88.4 |

* cited by examiner

*Primary Examiner* — Faye Francis
(74) *Attorney, Agent, or Firm* — Larry E. Severin

(57) ABSTRACT

A hopper for a roof shingle stripper, grinder, and blower includes: a hopper; a catch area on the hopper, adapted to receive the debris; an output opening on the hopper, adapted to output the debris; a plate to urge the debris toward the output opening; and a manipulator connected to the plate having a portion that extends outside of the hopper. The manipulator pushes upon the plate thereby urging debris in the hopper toward the output opening. The grinder machine may include a motor, self-propelled wheels, a lifting blade for roof shingles, a shredder, and a conduit with a wall that channels the debris to one of two outputs.

5 Claims, 6 Drawing Sheets

ROOF SHINGLE STRIPPER, GRINDER, BLOWER, AND HOPPER

RELATED APPLICATIONS

This application claims the benefit of the filing date of U.S. patent application Ser. No. 12/683,408, filed Jan. 6, 2010, which is incorporated herein by reference in its entirety, and U.S. Patent Application No. 61/155,212, filed Feb. 25, 2009, which is incorporated herein by reference in its entirety.

BACKGROUND OF THE INVENTION

The present invention generally relates to roofing and more specifically to a roof shingle stripper, grinder, blower, and hopper.

It takes many men to remove the shingles from a roof, and it becomes a very messy job on the roof and ground being a costly project.

For some roofs, portions may be too small or inaccessible to use a grinding machine directly upon the roof. If the grinder must be left on the ground, it might not be convenient to feed shingles into the grinder by hand.

It would be desirable to have a device for removing shingles from a roof.

SUMMARY OF THE INVENTION

In one aspect of the present invention, a device for handling debris includes: a hopper; a catch area on the hopper, adapted to receive the debris; an output opening on the hopper, adapted to output the debris; a plate to urge the debris toward the output opening; and a manipulator connected to the plate having a portion that extends outside of the hopper, wherein the manipulator pushes upon the plate thereby urging debris in the hopper toward the output opening.

In another aspect of the present invention, a system for collecting debris includes: a shredder; a lifting blade that lifts the debris and provides the debris to the shredder; self-propelled wheels to move the system forward; a motor to power the shredder, the lifting blade, and the wheels; a wall that transitions between a first position and a second position; a conduit having a first output, a second output, and a wall that channels the debris to one of outputs; and a removable hopper having a catch area to receive the debris and a plate that urges debris out of the hopper and into the shredder.

In yet another aspect of the present invention, a method for handling debris includes: utilizing a catch area to receive the debris into a hopper; utilizing a manipulator to press upon a plate within the hopper; and pressing upon the debris in the hopper with the plate to urge the debris out of an output opening the hopper.

DETAILED DESCRIPTION

Figure 1:
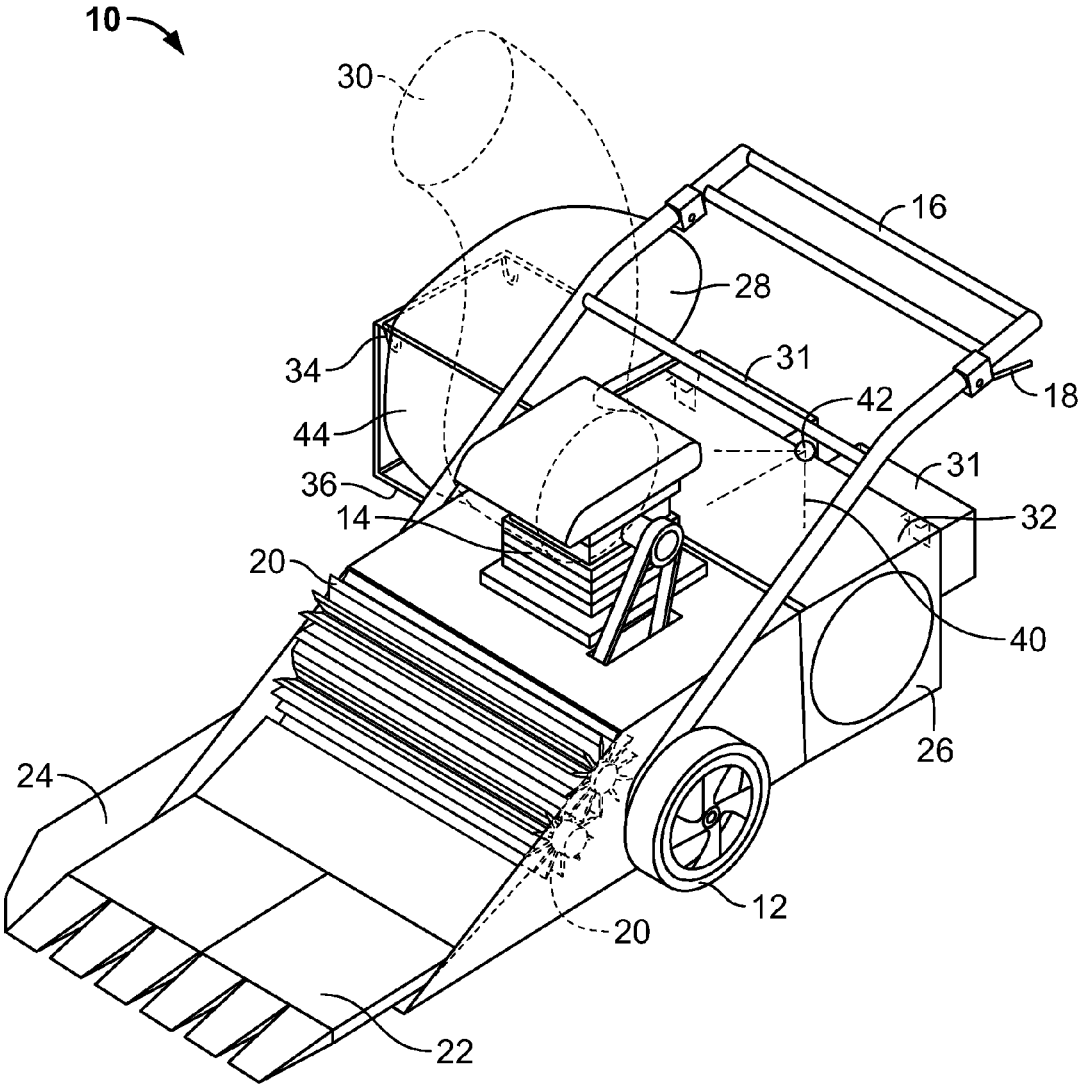
FIG. 1 is a perspective view of an embodiment of the invention.
Figure 2:
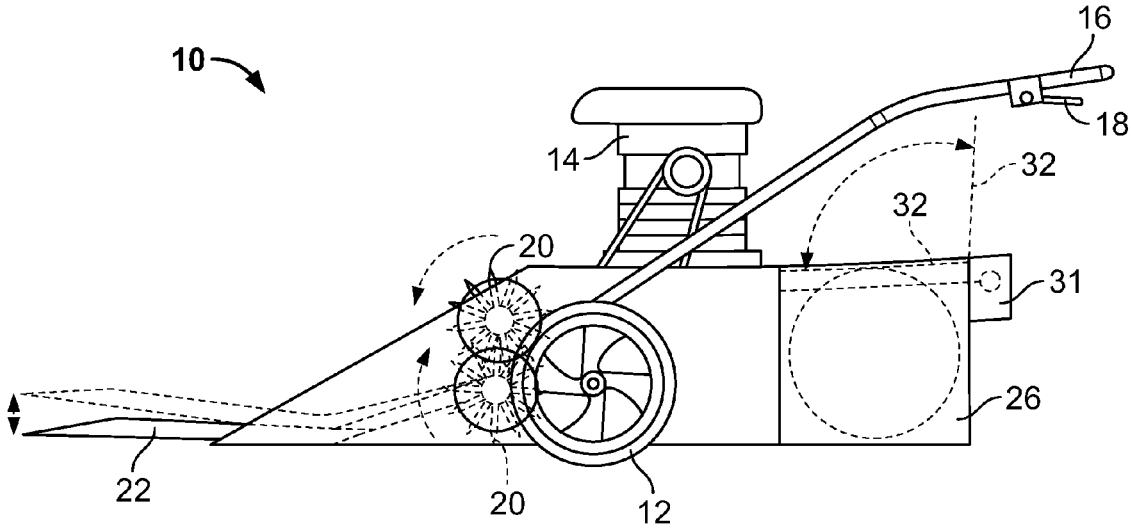
FIG. 2 is a side view of an embodiment of the invention.
Figure 3:
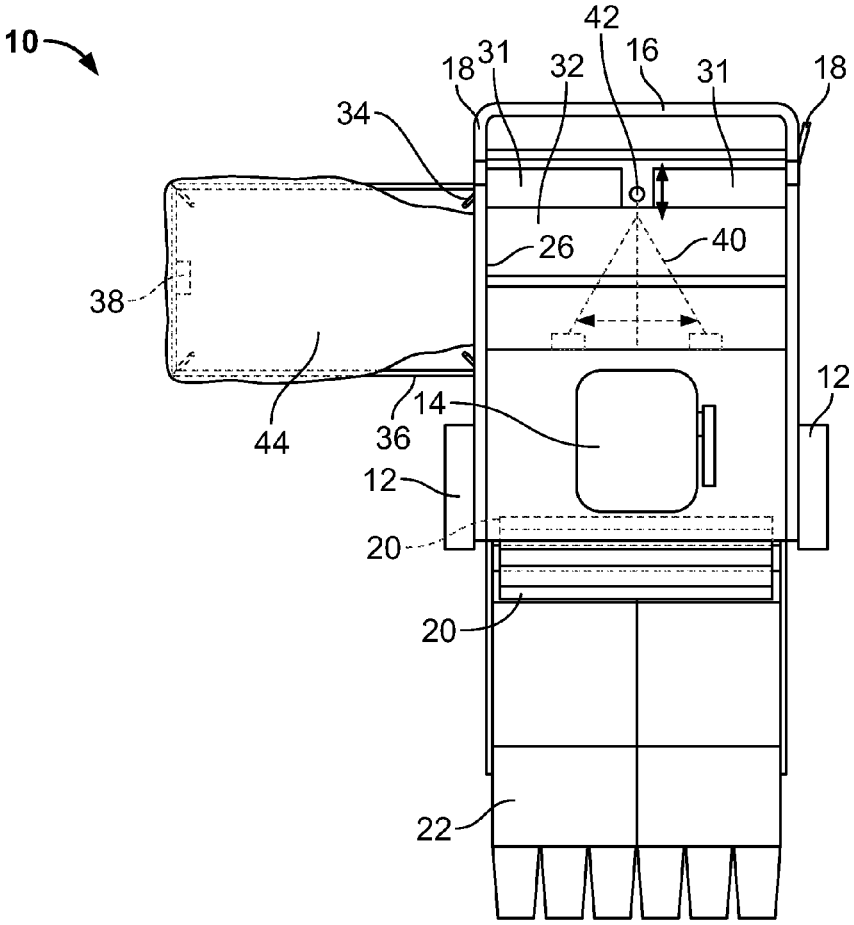
FIG. 3 is a top view of an embodiment of the invention.
Figure 4:
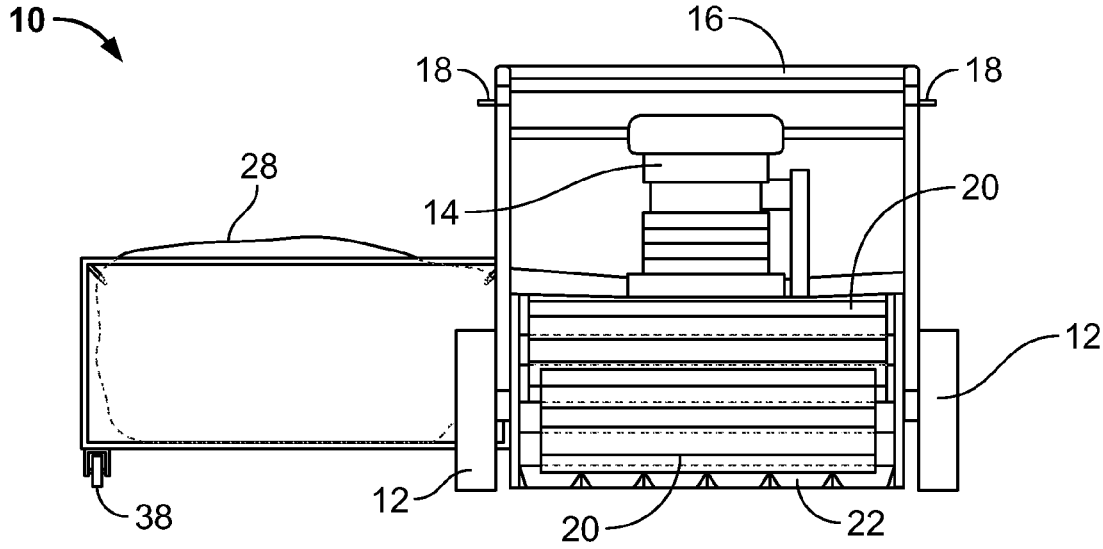
FIG. 4 is a front view of an embodiment of the invention.

The preferred embodiment and other embodiments, including the best mode of carrying out the invention, are hereby described in detail with reference to the drawings. Further embodiments, features and advantages will become apparent from the ensuing description or may be learned without undue experimentation. The figures are not drawn to scale, except where otherwise indicated. The following description of embodiments, even if phrased in terms of "the invention," is not to be taken in a limiting sense, but describes the manner and process of making and using the invention. The coverage of this patent will be described in the claims. The order in which steps are listed in the claims does not indicate that the steps must be performed in that order.

An embodiment of the present invention generally provides a roof shingle stripper, grinder, and blower. This may include a device that strips shingles off a roof, grinds the shingles up into tiny pieces, and blows the pieces into a bag attached to the stripper for removal. An embodiment takes one person to perform the work. It keeps the project clean and safe, as well as performing the work in half of the time.

As depicted in FIGS. 1, 2, 3, and 4, an embodiment of the present invention may include a grinder machine 10 having self-propelled wheels 12, driven by a gas motor 14. A handle 16 for driving the device holds levers 18 to control the motor 14. Grinding wheels 20 are fed by a lifting blade 22 with a guard 24. A box 26, which is a square tube or other conduit, retains a bag 28 or a flexible hose 30. Inside the box 26, an adjustable side wall 40 diverts the debris to the side. Adjustable side wall 40 may be adjusted with a knob 42 to output the debris to either side. A magnetic box 31 may catch nails or staples. A hinged clean out lid 32 allows access to on the box 26. In an embodiment, a removable bag rack basket 36 or frame has bag hooks 34 to hold the bag 28, plus a wheel 38 on the outside of the frame.

An embodiment may lift up and dislodge shingles from a residential or commercial roof that has been either nailed or stapled down. The slopes may range from a ½"/12 pitch to a 5"/12 pitch roof. When the roof sloop exceeds 5"/12 pitch, this machine may have a "U" shape hook that is attached to both sides of the machine to stabilize it on the roof for safety. The machine then may have a pulley with a rope attached to the machine on either side.

In an embodiment, once the shingles are lifted from the plywood roof, the shingles are forced back into a double wheel shedder or grinder that breaks the shingles into tiny pieces. Once the shingles go through the grinding wheels, they are blown out by force of the double wheel into a catch bag or flexible hose, mounted to aluminum tubing mounted to the side of the machine.

In an embodiment, the square aluminum box 26 has two directions in which the debris may be forced out. There is a moveable side wall 42 that may be changed from the right to the left depending on the direction the operator is moving the machine. This may be altered in direction, utilizing a knob 42 near the rear of the aluminum box 26. The side wall 42 locks into place, and will deflect and output debris ground up by the grinding wheels 20 to the left or right side of the machine.

In an embodiment, behind the aluminum box 26 is a magnet container 31 that will pull the nails or staples into a box. This will separate the ground-up shingles from the metal fasteners, so that the debris is recyclable waste. Since an embodiment is a self propelled machine, so it does not require pushing or pulling to perform the operation of removing, grinding and blowing the pieces into the holding bag.

An embodiment of this machine may come as three pieces: the stripper machine, the frame for the catch bag, and the catch bag. The machine may be loaded to the roof by two different methods: a belt escalator that reaches to the eave of a roof, or it may be carried up a ladder to reaches the roof. Once the machine is on the roof, the operator may assemble the parts of the machine.

In an embodiment, a removable frame 36 may be attached on the right or left side (depending on the direction the operator is going to move). The grinder machine 10 may include two extensions of 1½" length bars, which the frame may be placed over to hold into place. The wheel 38 on the outside of the frame 36 sustains the frame parallel to the slope of the roof as the machine goes across the roof. A pin may be pushed through a hole to lock the frame (into place.

Figure 5:
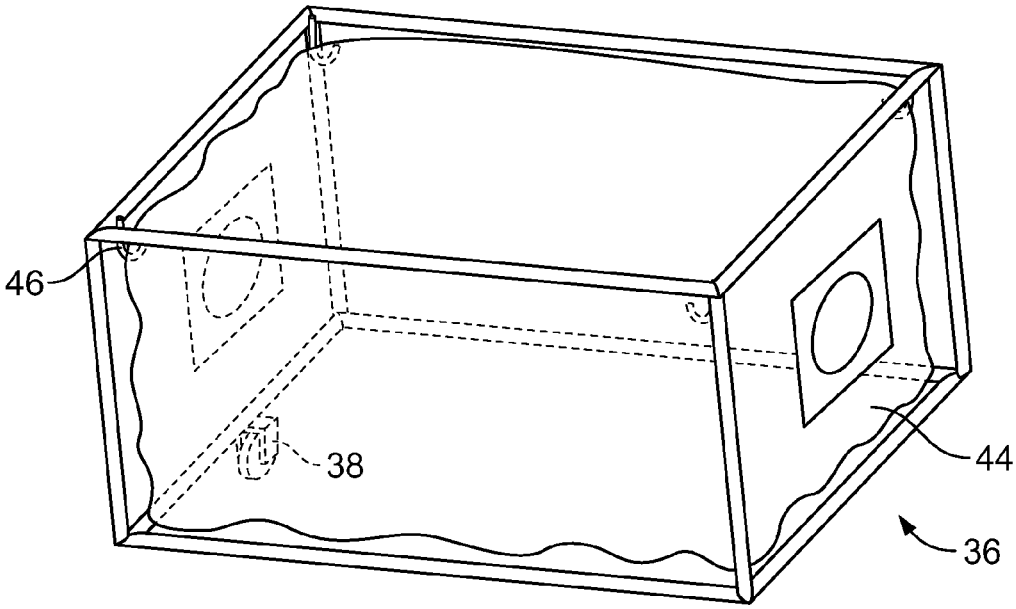
FIG. 5 is depicts an embodiment of a bag frame according to the present invention.

As depicted in the embodiment of FIG. 5, when an embodiment of a bag frame 36 is mounted to the two extended bars and in place, the bag 44 may then be placed inside the frame 36. The frame 36 has four hooks 46, and the bag 44 has four metal eyes that is hook to the frame. This stabilizes the bag from falling out once the bag is being filled with recycle debris from the roof.

Figure 6:
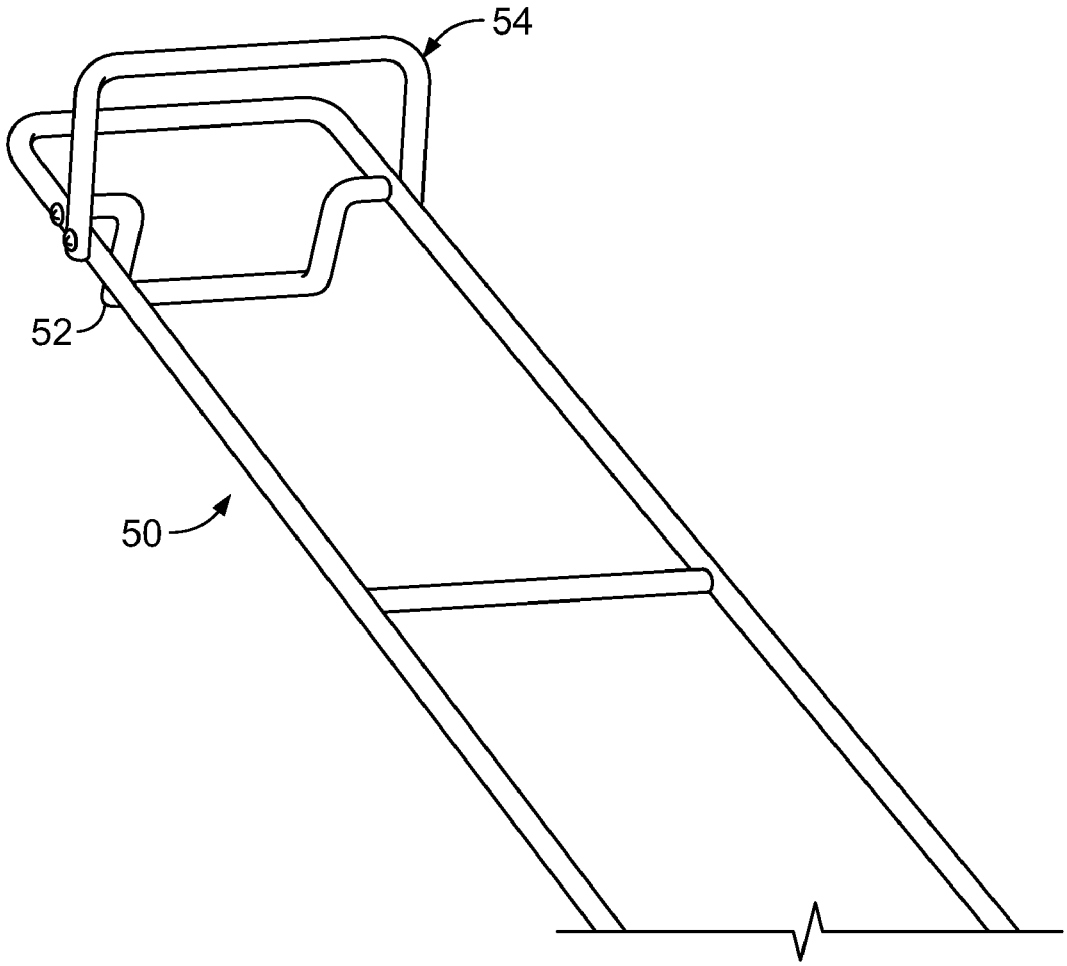
FIG. 6 depicts an embodiment of a handle according to the present invention.

As depicted in FIG. 6, an embodiment of a handle 50 includes a bottom bar 52 to control the wheels and a top bar 54 to control the grinder and lift blades. The bars 52, 54 are parallel to the handle 50 and go across the machine. To start the machine the top bar 54 is held down to the handle allowing the engine to be in the neutral position. There may be a clear rubber prime button on the front of the engine that should be pushed 3 times to prime the engine. Once the button has been pushed, a pull rope is pulled to start engine. If the engine does not start, repeat the process. After the start of the engine, the top bar 54 operates the lifting of the lifting blade 22 in front of the machine, and starts the grinding wheels 20 and turning of the self-propelled wheels 12. To stop the forward motion of the machine, release the bottom bar 52 on the handle.

In an embodiment, if the machine grinding cylinders become clogged or there is a back up in the aluminum box, a lid 32 that may be lifted for cleaning and repair of the grinding wheels 20. This lid 32 may allow a cleaning periodically for good maintenance of the machine.

In an embodiment, once the bag is ⅔ filled, the bag may be released from the hooks that has held it in place and emptied in two ways: dumped into dump truck, or recycle debris is dumped into a bag and placed into a dump truck or a pick-up truck. After the bag is emptied it may be placed back into the rack and the engine may be restarted by following the above process.

An embodiment may include a machine which is light weight with two small wheels that is self propelled. The motor is a gas machine that is light weight and small in size, that may be started by a pull rope. On the handle of the machine are two levers which activate the self propelling wheels and the grinding wheels. The machine has a blade that sticks out about 12" that is about 24" wide. The blade lifts up about 2" to break the shingles loose. On the side of the removing blade is a metal or plastic guard that may be repositioned on the right or left of the lifting blade, keeping the shingles from falling off the machine. The self propelled machine forces the shingles into a grinding wheel that blows the shingles through a square tube. On the side of the tube may be a canvas plastic bag attached to the machine that will receive the grounded up debris of shingles in tiny pieces. The rack that holds the bags may be repositioned to the right or left side of the machine for convenience. The bag may either be tied if it is a plastic bag or thrown away, or a canvas bag can be empty into a dump truck. This may keep the project clean with one person performing the work in half the time.

In an embodiment, the lifting plates are from 12" 28" wide. The grinder is two drums with cutting blades that are 2½" long for grinding the shingles. The grinder spins by a belt or chain that will blow the shingles through an aluminum square tube that is about 8" by 8" into a bag. The bag holder may be an aluminum rod about ¼" to ½" depending on the size of bag desired to use. The side blade that keeps the shingles from falling off may be 2½" by 26" and may be attached to a ¼" rod that may snap into a hole on either the right or left side of the blade in front of the machine. The front blade on the side of the cutting blade may be moved from the right side or to the left side. The bag where the shingles are blown in may also be moved from the right to left side.

Figure 7:
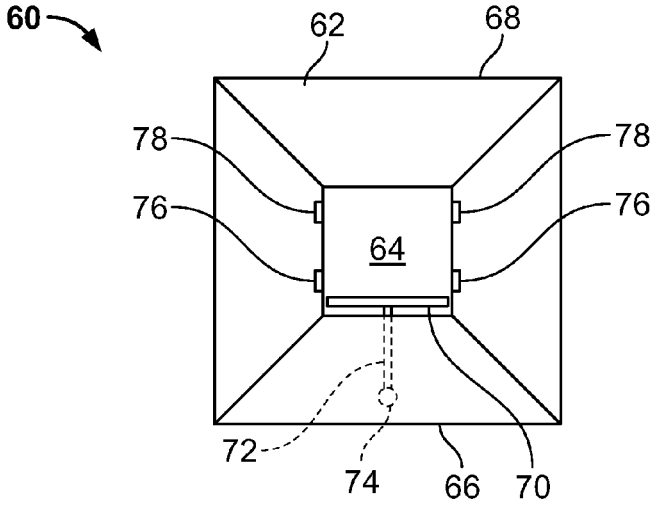
FIG. 7 is a top view of an embodiment of a hopper according to the present invention.

In an alternate embodiment, a portable grinding machine may stay on the ground, possibly because the area to be stripped is too small or otherwise inaccessible, such as, for example, a domer with a sheet of half-width shingles. The debris may be removed from the roof by hand and thrown into a hopper, to be ground up by a grinder and blown either into a bag or through a hose into a waste container on the ground. A handle for the grinder may have a lock hook for the top bar that will cause the grinding wheels to continue to run until the lock is released. The hopper may have a flat plate inside so debris can be pushed into the grinder wheels when needed. A manipulator connected to the plate has a bar or arm that extends outside of the hopper, so the user may push on or operate the bar so the plate pushes the debris toward the output opening As depicted in the embodiment of FIG. 7, a hopper 60 may include a hopper catch area 62 that angles out to help collect debris and shingles and direct the debris to the hopper bottom 64. The hopper bottom 64 is angled relative to the hopper so as to be lower near the front 66 of the hopper and higher near the back 68 of the hopper, thereby accommodating attachment of the hopper to a grinder so the back of the hopper feeds debris into the front of the grinder. The hopper bottom 64 is generally open and may be formed by the front 66, back 68, and sides of the hopper. A push plate 70 may press debris from the front 66 toward the back 68 to help feed the grinder. The plate 70 may slide horizontally or along an angled line, or the plate 70 may be relatively loose to allow movement in multiple directions. The user may utilize a push bar 72 or other manipulator with a handle 74 to press the push plate 70 against the debris. Debris in the hopper may be pushed rearward into the grinder. The angle of the hopper bottom 64 may align with the grinding machine, so that the plate will push the debris so that it passes into the grinding wheels of the machine. The hopper 60 may have forward brackets 76 and rearward brackets 78 to releasably attach the hopper to the grinder.

Figure 8:
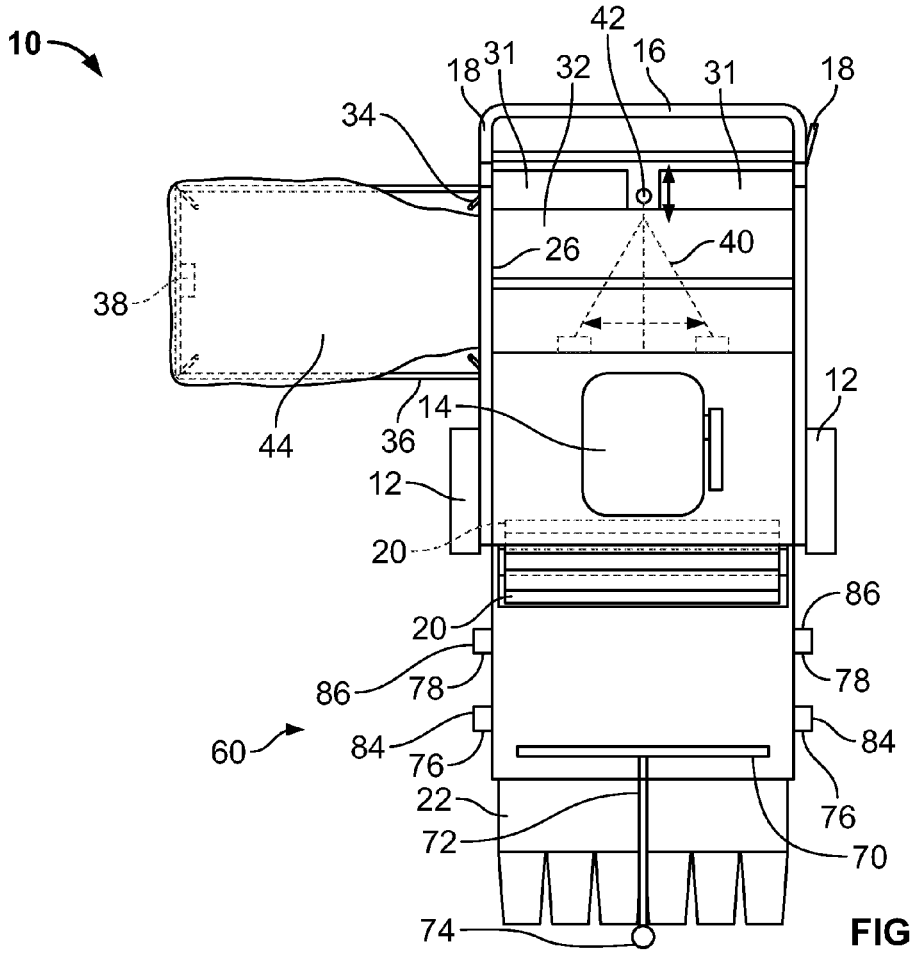
FIG. 8 is a top view of the hopper of FIG. 7 attached to a grinder according to the present invention.
Figure 9:
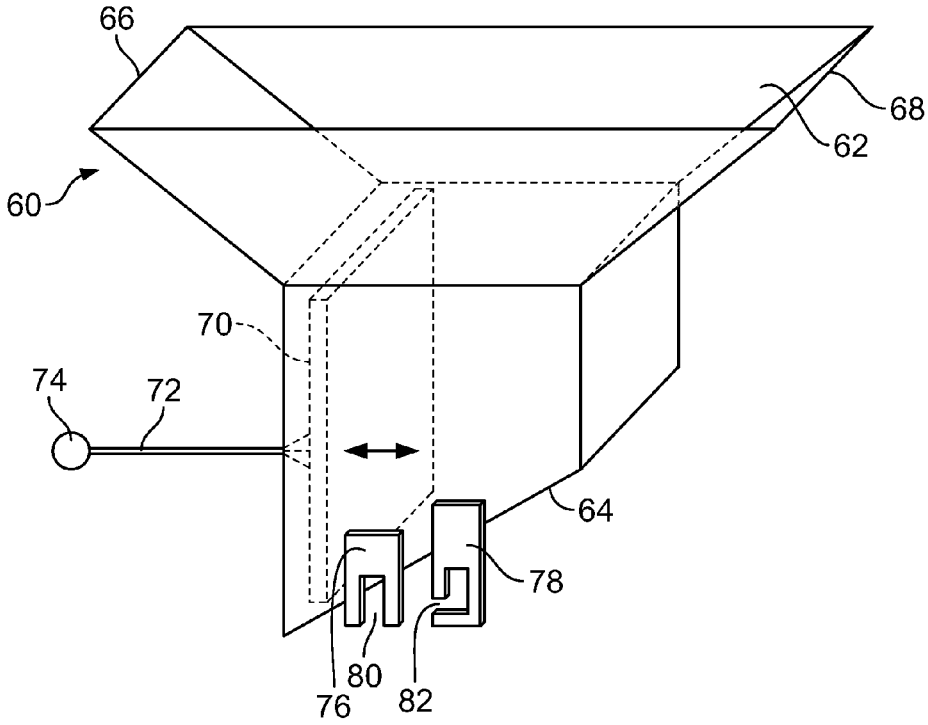
FIG. 9 is a perspective view of the hopper of FIG. 7.
Figure 10:
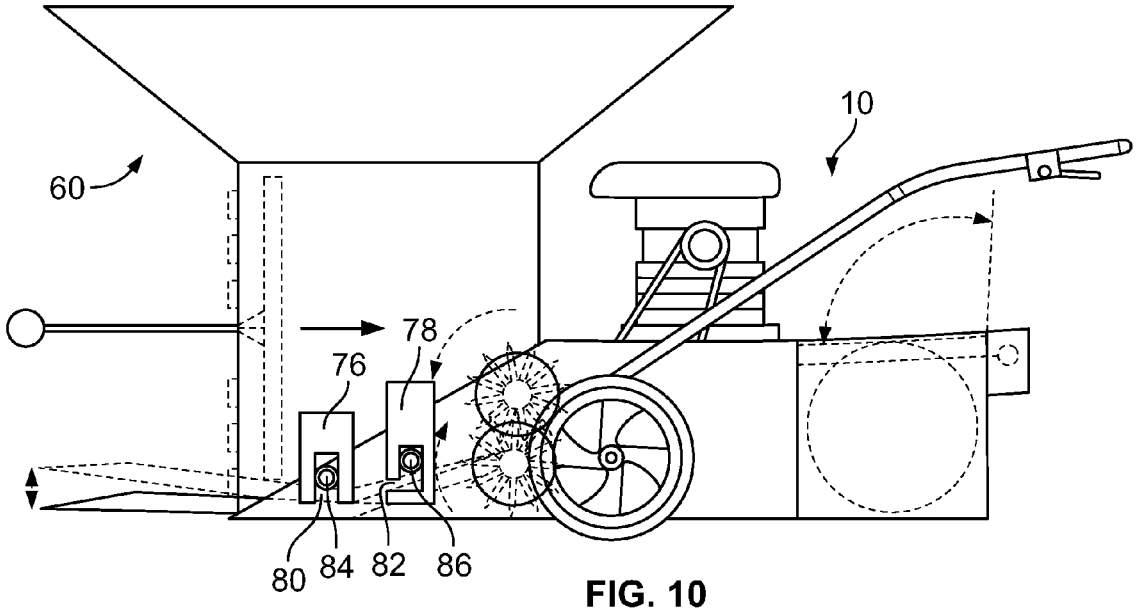
FIG. 10 is a side view of the hopper and grinder of FIG. 8.

As depicted in the embodiment of FIG. 8, a hopper 60 may attach to a portable grinder machine 10 to help feed debris to the grinder machine 10. The grinder machine 10 may include forward pins 84, to engage with forward brackets 76 on the hopper 60, and rearward pins 86, to engage with rearward brackets 78 on the hopper. As depicted in the embodiment of FIG. 9, forward bracket 76 may have a slot or aperture 80, and rearward bracket 78 may have a slot or aperture 82. As depicted in the embodiment of FIG. 10, the slots 80, 82 in the brackets 76, 78 may engage with pins 84, 86 on the grinder machine 10 to hold the hopper 60 to the grinder machine 10 so that the hopper 60 may be conveniently attached or detached as needed.

In an embodiment, the hopper may be portable, and attachable to a grinder that may be stationary. In another embodiment, the hopper may be stationary and the grinder may be portable. In yet another embodiment, both the hopper and grinder may be portable. In an embodiment, the grinder machine may be driven directly on a roof to strip and grind shingles when appropriate, and used with the hopper when shingles are otherwise collected for grinding, perhaps by hand or with hand tools.

We claim:

1. A system for collecting debris, comprising:

a shredder;

a lifting blade that lifts the debris and provides the debris to the shredder;

self-propelled wheels to move the system forward;

a motor to power the shredder, the lifting blade, and the wheels;

a wall that transitions between a first position and a second position;

a conduit having a first output, and a second output, wherein the wall channels the debris to one of the outputs; and a removable hopper having a catch area to receive the debris and a plate that urges debris out of the hopper and into the shredder.

2. The system of claim 1, further comprising:

a manipulator on the hopper, connected to the plate and having a portion that extends outside of the hopper, wherein the manipulator pushes upon the plate to urge the debris toward the shredder.

3. The system of claim 1, further comprising:

a bracket on the hopper, adapted to releasably attach the hopper to the shredder.

4. A method for handling debris, comprising:

utilizing a catch area to receive the debris into a hopper;

utilizing a manipulator to press upon a plate within the hopper;

pressing upon the debris in the hopper with the plate to urge the debris out of an output opening of the hopper;

releasably attaching the hopper to a grinder machine including a roof shingle stripper, grinder, and blower, so that debris including shingles passing out of the output opening is fed into the grinder of the grinder machine;

removing the hopper from the grinder machine; and utilizing the grinder machine without the hopper to strip and grind shingles on a roof.

5. A method for handling debris, comprising:

utilizing a catch area to receive the debris into a hopper;

utilizing a manipulator to press upon a plate within the hopper;

pressing upon the debris in the hopper with the plate to urge the debris out of an output opening of the hopper;

releasably attaching the hopper to a grinder machine so as to provide a first debris to the grinder machine;

propelling the grinder machine forward so as to receive a second debris into the grinder machine;

shredding the first and second debris into pieces; and providing the shredded debris to a conduit having a wall that, when the wall is in a first position, diverts the pieces in a first direction, and when the wall is in a second position, diverts the pieces in a second direction.

* * * * *